United States Patent [19]

Yamasaki et al.

[11] 4,061,311

[45] Dec. 6, 1977

[54] AIR HOIST AND ITS CONTROL DEVICE

[75] Inventors: Akitosi Yamasaki, Takatsuki; Kiyoshi Fukuyama; Kazunori Miyauchi, both of Neyagawa, all of Japan

[73] Assignee: Tsubakimoto Chain Company, Osaka, Japan

[21] Appl. No.: 691,670

[22] Filed: May 28, 1976

[30] Foreign Application Priority Data

| | | |
|---|---|---|
| June 2, 1975 | Japan | 50-65279 |
| Nov. 14, 1975 | Japan | 50-136312 |
| Nov. 14, 1975 | Japan | 50-136313 |

[51] Int. Cl.[2] ..... B66D 1/08

[52] U.S. Cl. ..... 254/168; 137/627.5

[58] Field of Search ..... 254/168, 167; 137/627.5; 254/150 R; 74/424.8 R, 89.15

[56] References Cited

U.S. PATENT DOCUMENTS

| | | | |
|---|---|---|---|
| 3,109,615 | 11/1963 | Fritz | 254/150 R |
| 3,384,350 | 5/1968 | Powell | 254/168 X |
| 3,756,563 | 9/1973 | Stone | 254/168 |
| 3,791,627 | 2/1974 | Stone et al. | 254/168 |
| 3,944,294 | 3/1976 | Masuda et al. | 137/627.5 X |
| 3,945,401 | 3/1976 | Greenwood | 137/627.5 |

*Primary Examiner*—Robert J. Spar
*Assistant Examiner*—Donald W. Underwood
*Attorney, Agent, or Firm*—Blanchard, Flynn, Thiel, Boutell & Tanis

[57] ABSTRACT

An air hoist having a reversely rotatable drum adapted to have an elongated flexible load-carrying element, such as a cable, wound onto or off of the drum to permit lifting or lowering of a load. The drum also serves as a reciprocating cylinder and is axially slidably disposed in sealed engagement with an internal piston which, while it rotates with the drum, is axially restrained. A fluid pressure chamber is formed between the end wall of the drum and the piston so that the pressure fluid which is supplied to or discharged from this chamber controls the axial displacement of the drum. A ball-screw arrangement coacts between the drum and a stationary support so as to cause rotation of the drum in response to axial movement thereof, whereby the drum undergoes a helical-type motion during winding or unwinding of the load-carrying element. A control device is associated with the hoist for controlling the flow of pressure fluid to or from the pressure chamber.

10 Claims, 8 Drawing Figures

AIR HOIST AND ITS CONTROL DEVICE

FIELD OF THE INVENTION

This invention relates to an improved air hoist in which the drum serves also as a reciprocating cylinder operated by a compressed fluid, and in which an improved control device is associated with the hoist for controlling the flow of fluid.

BACKGROUND OF THE INVENTION

In a conventional air hoist employing a ball-screw mechanism, the drum of the hoist is rotated through the ball-screw mechanism by a piston which is reciprocated within a cylinder by means of a compressed fluid. In this conventional structure, the cylinder and drum are made separately so that the cylinder must have sufficient length to accommodate the reciprocating distance of the piston. This increases not only the size of the entire hoist, but also the number of component parts, and thus makes it difficult to obtain a small and low-cost hoist.

Several attempts have been made to use the drum itself as the cylinder to receive the piston which is operated by the high-pressure fluid. These attempts, however, have created the problem that the pressure of the working fluid must be substantially increased in order to overcome the large rotational and reciprocal resistance to which the piston is subjected when the drum turns.

In addition, the control device for regulating the operation of conventional air hoists is able to perform its control function under any of the lifting, lowering or stopping conditions so long as the load being hoisted is maintained constant. However, the know control devices have been unable to keep the hoisted load in a balanced condition when the load changes, unless the control pressure is appropriately adjusted with each change.

Thus, it is an object of this invention to provide an improved air hoist, and a control device therefor, which overcomes the aforesaid shortcomings.

DETAILED DESCRIPTION

Figure 1:
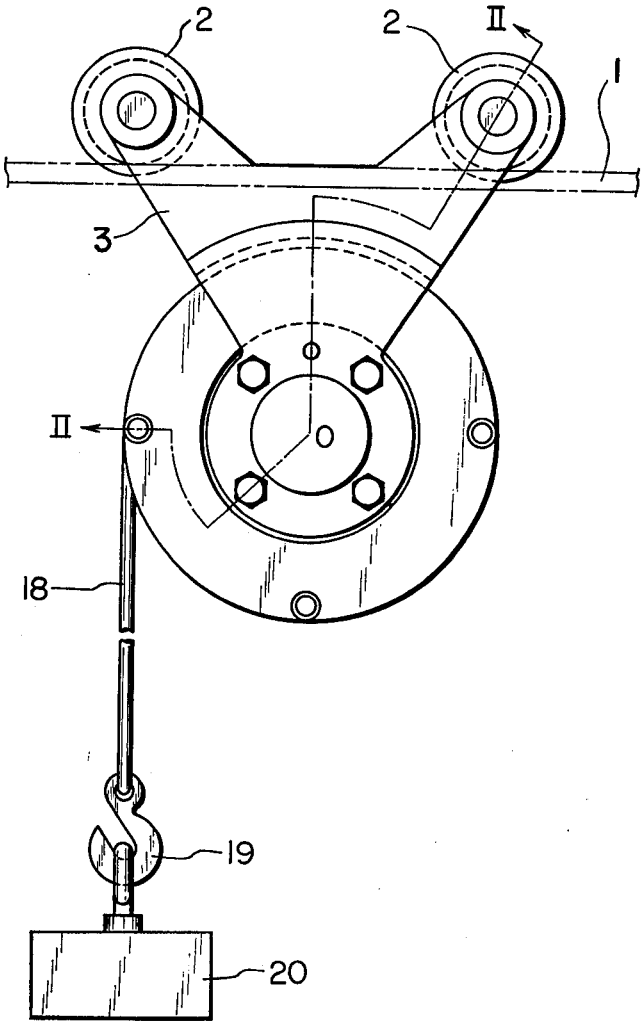
FIG. 1 is a side elevational view of a drum hoist.
Figure 2:
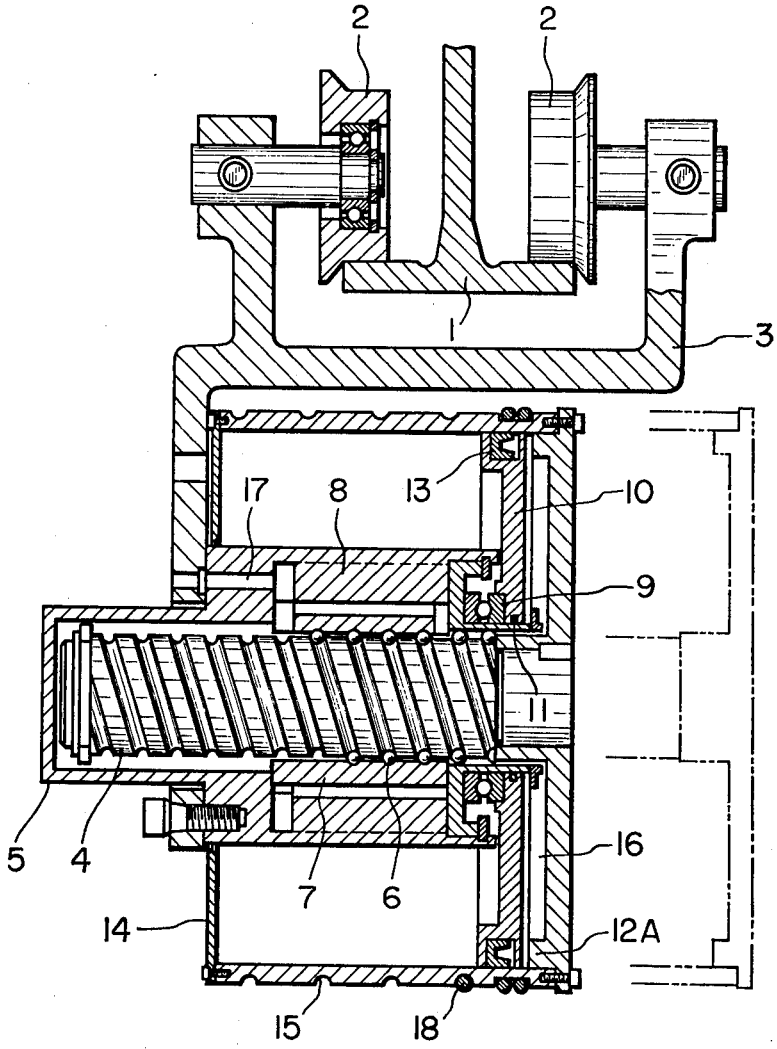
FIG. 2 is a sectional view taken along the line II-II in FIG. 1.

Referring to FIGS. 1 and 2, there is shown a drum-type air hoist having a support frame or member 3 which is supported from the axles of a plurality of opposed pairs of wheels 2, which wheels are rollingly supported on a suspended stationary support rail 1. The support member 3 has a hollow cylindrical part 5 in which is accommodated a ball-screw device. The ball-screw device is of conventional construction in that it includes a screw shaft 4 which, as shown in FIG. 2, has its rotational axis extending horizontally so as to be substantially coaxially aligned with the cylindrical part 5. The screw shaft 4 is disposed in engagement with a stationary or fixed nut 7 by means of balls 6 disposed therebetween. The nut 7 is fixedly associated with a piston holder 8 which is stationary and forms part of the cylindrical part 5. At one end of the piston holder 8, there is rotatably supported an annular piston 10, which piston is rotatably supported on the stationary holder 8 by an anti-friction bearing 9.

An annular seal 11 is disposed between the inner periphery of the piston 10 and the stationary holder 8 so as to create a sealed engagement therebetween while permitting the piston 10 to rotate with respect to the holder 8. A further annular seal 13 surrounds the external periphery of the piston 10 and is disposed in sliding sealing engagement with the inner peripheral wall of a drum-cylinder 12.

The front end (rightward end in FIG. 2) of the drum-cylinder 12 is provided with an end wall 12A which is fixed to the front end of the screw 4, whereas the rearward end of the drum-cylinder 12 has a cover 14 which is held in slidable contact with the piston holder 8. When the drum-cylinder 12 advances to the farthest end of its stroke, which advance occurs rightwardly in FIG. 2, the cover 14 moves into contact with the rearward (leftward) surface of the piston 10 so as to restrain any further advance of the drum-cylinder 12. The drum-cylinder 12 also has grooves 15 formed in the external surface thereof, which groove normally extends helically around the drum.

The support member 3, and particularly the piston holder 8, has a passage 17 formed therein, which passage communicates with the interior of the cylindrical part 5, and also communicates with a pressure chamber 16 which is defined between the piston 10 and the cylinder end wall 12A. The passage 17 is used for supplying pressure fluid, such as pressurized air, into the cylindrical part 5 and the pressure chamber 16.

A wire rope 18 or other flexible load supporting element is wound around the external surface of the drum-cylinder 12, which rope 18 is received within the groove 15. A hook 19 is normally fitted to the free end of the rope 18 so as to suspend a load 20 from the hoist.

When a high-pressure fluid is fed through the passage 17 into the cylindrical part 5 and into the pressure chamber 16, the pressue fluid acts against the inner surface of the end wall 12A of the drum-cylinder 12, thereby causing the drum-cylinder 12 to advance axially (move rightwardly in FIG. 2) with respect to the piston 10 into a position substantially as shown by a double-dot-dash line in FIG. 2. Since the pressure inside the hollow cylindrical part 5 is equal to the pressure which exists in the chamber 16, the pressurized fluid thus effectively acts on a surface area equivalent to the full surface area of the end wall 12A as defined by the diameter thereof, so that the drum-cylinder 12 thus advances rapidly in response to the pressure fluid being supplied to the chamber 16, thereby resulting in a substantial reduction in the response time of the hoist.

When the drum-cylinder 12 axially advances outwardly due to the pressure fluid being supplied to the chamber 16, as explained above, the screw 4 also moves axially outwardly due to its being fixed to the drum-cylinder 12, so that the screw thus advances outwardly with respect to the nut 7 which is fixed to the piston holder 8. Accordingly, the screw 4 rotates within the nut 7 as it axially advances outwardly, which rotation of the screw causes a corresponding rotation of the drum-cylinder 12 as it advances axially outwardly. Since the piston 10 is rotatably supported on the piston holder 8 by means of the bearing 9, the piston 10 also rotates with the drum-cylinder 12. However, piston 10 is restrained from moving axially, so that the seal 13 and piston 10 are thus axially displaced relative to the drum-cylinder 12 as it advances outwardly. This relative movement between the drum-cylinder 12 and piston 10 solely constitutes a relative slidable displacement in the axial direction, which slidable displacement is accommodated by the seal 13. The seal resistance to the forward axial motion of the drum-cylinder 12 can thus be minimized by selecting a suitable slidable seal 13 offering the least resistance to such axial sliding motion between the piston 10 and drum-cylinder 12. Similarly, since piston 10 does not move axially, but does rotate with respect to the holder 8, the seal 11 accommodates and experiences only relative rotation between these parts. By suitably selecting this seal 11 so as to offer minimum resistance to such rotation, the advancing movement of the drum-cylinder 12, which advancing movement occurs in a helical manner since it involves a simultaneous rotation and a linear displacement, can occur in a simple and smooth manner. As the drum-cylinder 12 advances, that is linearly moves outwardly, it undergoes a rotation which results in the wire rope 18 being wound upon the drum-cylinder 12 so as to raise the load 20. The motion of the drum-cylinder 12 is terminated when the rear cover 14 comes into contact with the backside of the piston 10.

When lowering of the load is desired, the pressurized fluid which exists within the cylindrical part 5 and within the chamber 16 is released through the passage 17, whereupon the weight of the load 20 acting through the cable 18 causes rotation of the drum-cylinder 12. This rotation of the drum-cylinder 12, acting through the ball-screw mechanism, causes axial retraction of the drum-cylinder 12 (which retraction is leftwardly in FIG. 2), whereby the wire rope 18 is paid off the drum so that the load is lowered. By stopping the discharge of the pressure fluid through the passage 17, this thus stops the drum-cylinder and permits the load 20 to remain stopped in a suspended condition.

The control of the pressure fluid which is supplied to or discharged from the hoist, particularly the interior of cylindrical part 5 and the chamber 16, is provided by a control device C, which device and its mode of operation will be described with reference to FIGS. 3–6.

This control device C includes a housing which has a passage 22 communicating with a pressurized fluid source 21 and a passage 23 communicating with said hoist passage 17. The passage 23 opens to a working fluid chamber 25 which is positioned on one side of a flexible diaphragm 24, which diaphragm has a diaphragm chamber 26 positioned on the other side thereof. A valve port 28 opens between the chamber 25 and a pressurized fluid chamber 27 that communicates with the passage 22. The valve port 28 is opened and closed by a valve 30 connected to a hollow valve rod 29 that is moved back and forth by the diaphragm 24. An opening 31 at one end of the hollow valve rod 29 is always pressed by a spring 32 against a center cover or plug 33 formed on the diaphragm 24. A guide rod 34, fitted to the cover 33, projects into the diaphragm chamber 26 and is movably inserted in a guide hole 35 formed in the housing wall of the diaphragm chamber 26. The diaphragm 24 is urged (leftwardly in FIG. 3) by a spring 36 toward the working fluid chamber 25. An opening 37 at the other end of the hollow valve rod 29 opens to the atmosphere.

The cross-sectional area of the guide rod 34 is equal to the cross-sectional area of the hollow valve rod 29 including its hollow part (hereinafter simply called the cross-sectional area). Therefore, when the cover 33 on the diaphragm 24 is pressed against the hollow valve rod 29, the diaphragm 24 receives pressure in the same area on both its working fluid chamber 25 and diaphragm chamber 26 sides.

A conduit 38, having the conduit parts 38A and 38B, interconnects the diaphragm and pressurized fluid chambers 26 and 27 to form a fluid circuit containing a lifting change-over valve $V_1$, a lowering change-over valve $V_2$ and a balancing change-over valve $V_3$, which valves are conventional, such as shiftable two-position spool valves. A fluid circuit is also formed between the working fluid chamber 25 and the lifting change-over valve $V_1$ by a further conduit 39. Reference numerals 40 and 41 denote throttle valves.

Figure 3:
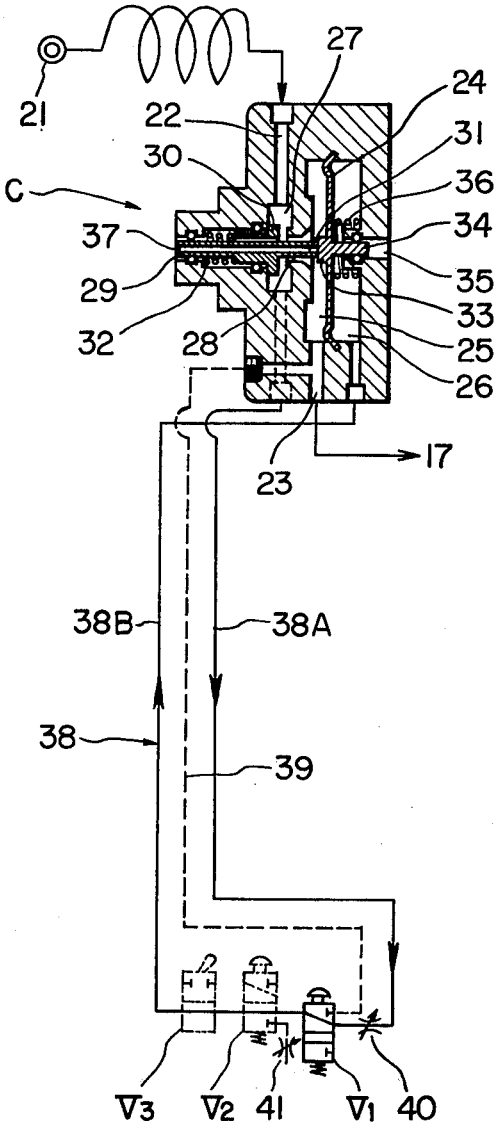
FIG. 3 is a cross-sectional view of a flow control device for the hoist when in a lifting condition.

In FIG. 3, the control device C is in a condition to lift the load 20. The lifting change-over valve $V_1$ is actuated to connect the fluid circuit defined by the conduits 38A and 38B. The high-pressure fluid in the pressurized fluid chamber 27, introduced from the pressurized fluid source 21, flows as shown by the arrow through conduits 38A and 38B into the diaphragm chamber 26. The diaphragm 24 is accordingly displaced toward the working fluid chamber 25. The cover 33 closes the opening 31 of the hollow valve rod 29, and pushes the valve rod 29 to the left in FIG. 3 to detach the valve 30 from the valve port 28 so that port 28 is then opened. This permits the pressurized fluid chamber 27 to communicate with the working fluid chamber 25, whereupon high-pressure fluid flows into the chamber 25. Fluid in chamber 25 then flows through the passages 23 and 17, so that the fluid is supplied into the pressure chamber 16 to rotatingly advance the drum-cylinder 12 as explained above, so that the wire rope 18 is wound up to raise the load 20.

Figure 4:
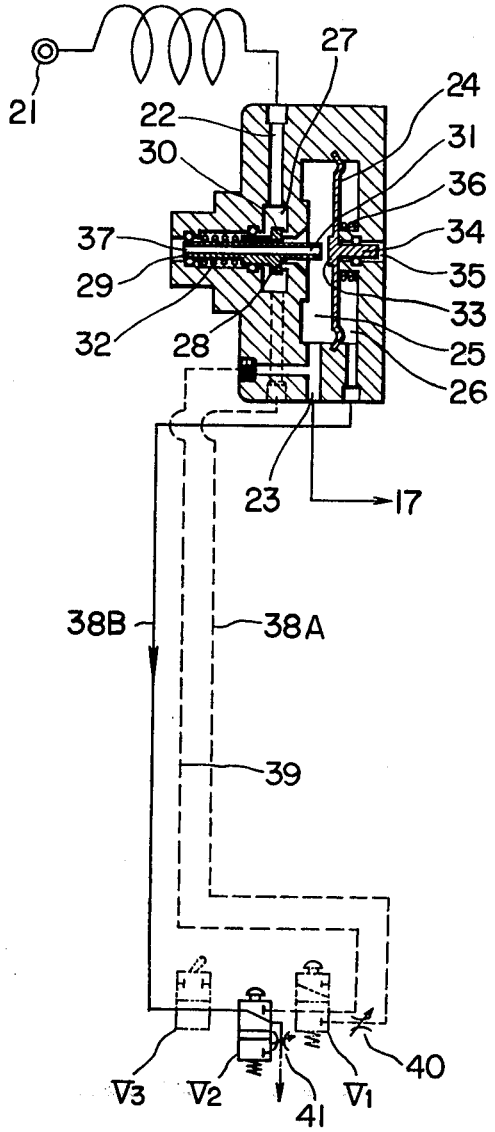
FIG. 4 is a view similar to FIG. 3 and showing the control device when the hoist is in a lowering condition.

FIG. 4 shows the control device C in a condition to lower the load 20. The lowering change-over valve $V_2$ is actuated to cut the fluid circuit formed by the conduits 38A and 38B. The fluid in the conduit 38B, which communicates with the diaphragm chamber 26 is discharged, as shown by the arrow, into the atmosphere through the throttle valve 41. The pressure in the diaphragm chamber 26 becomes lower than that in the working fluid chamber 25. This displaces the diaphragm 24 to the right and detaches the cover 33 from the opening 31 of the hollow valve rod 33 so that the opening 31 opens. At the same time, the spring 32 moves the valve rod 29 to the right and the valve 30 closes the valve port 28.

Consequently, the high-pressure fluid in the working fluid chamber 25 enters the passage in the hollow valve rod 29 from its opening 31 and is discharged into the atmosphere from its other opening 37. This lowers the pressure of the fluid in the air-hoist pressure chamber 16. Then the drum-cylinder 24 reverses under the influence of the self-weight of the load 20, thereby paying off the wire rope 18 and lowering the load 20.

Figure 5:
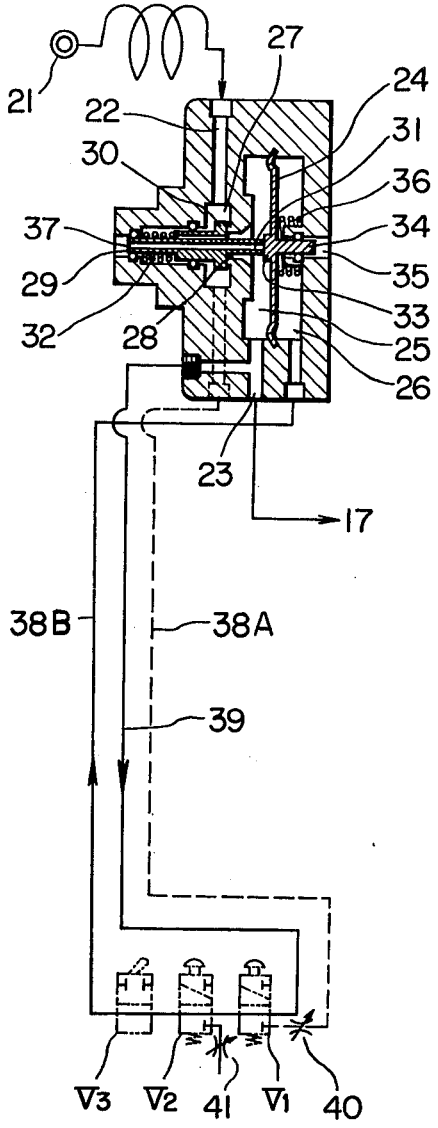
FIG. 5 is a similar view of the control device when the hoist is in a stopping condition.

FIG. 5 shows the control device C in a condition to keep the load 20 at a standstill. The change-over valves $V_1$, $V_2$ and $V_3$ are actuated so as to form an intercommunicating fluid circuit between the working fluid chamber 25 and diaphragm chamber 26 through the conduits 38 and 39. Thus, the pressure in the working fluid and diaphragm chambers 25 and 26 is equalized. At this time, because the diaphragm 24 receives pressure on the same area on both of its sides as mentioned previously, the diaphragm 24 is in a neutral position wherein it lightly closes the opening 31 of the hollow valve rod 29, being urged into this position by slight elasticity of the spring 36. Since the valve rod 29 is thus not permitted to move to the left due to the urging of spring 32, the valve 30 closes the valve port 28 and the high-pressure fluid in the pressurized fluid chamber 27 is prevented from flowing into the working fluid chamber 25. Besides, there is no possibility of the high-pressure fluid in the working fluid chamber 25 forcing the valve 30 open, since the fluid pressure in the working fluid chamber 25 and the pressurized fluid chamber 27 works on the same area on both sides of the valve 30.

Consequently, neither supply nor discharge of high-pressure fluid occurs in the working fluid chamber 25, which causes the drum-cylinder 12 to remain at a standstill. Therefore, the load 20 is neither lifted nor lowered, but is kept suspended in midair.

Figure 6:
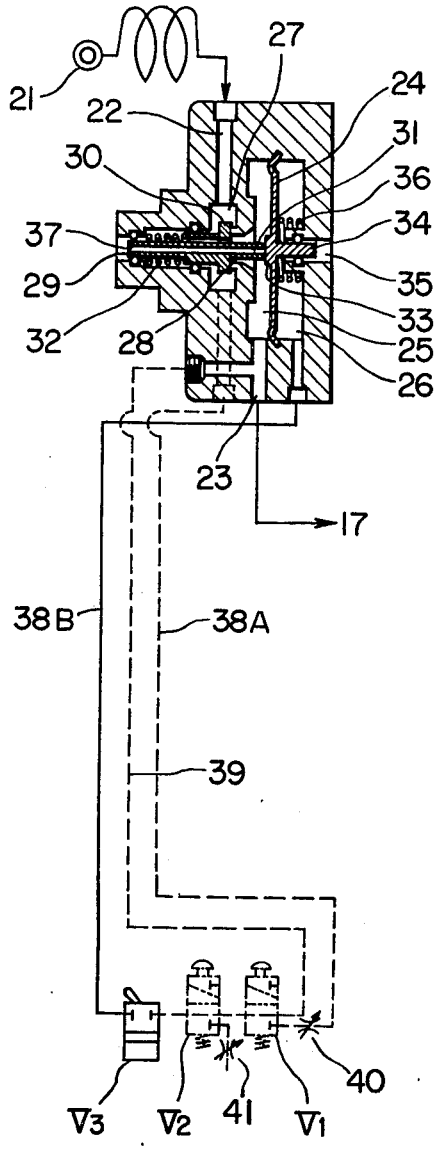
FIG. 6 shows the control device when the hoist is in a balanced condition.

FIG. 6 shows the control device C in a condition in which the load 20 is kept in a balanced state. The balancing change-over valve $V_3$ is actuated to cut both fluid curcuits as defined by the conduits 38 and 39, since valve $V_3$ cuts the conduit 38B. The fluid pressure in the diaphragm chamber 26 becomes constant. If the load 20 is lowered by use of external force, the pressure in the air-hoist pressure chamber 16 increases since the volume of chamber 16 decreases causing further compression of the fluid (air), and thereby raising the pressure inside the working fluid chamber 25. This pressure rise causes th diaphragm 24 to move to the right in FIG. 6, which in turn opens the opening 31 of the valve rod 29, discharges the high-pressure fluid in the working fluid chamber 25 through the hollow valve rod 29 into the atmosphere, and permits continuing of the lowering of the load 20 by application of external force.

If the load 20 is raised by external force, the pressure inside the air-hoist pressure chamber 16 (and in chamber 25) becomes lower than the constant pressure in the diaphragm chamber 26, thus moving the diaphragm 24 to the left in FIG. 6. This causes the valve rod 29 to move to the left, opening the valve port 28. Then the high-pressure fluid in the pressurized fluid chamber 27 flows into the working fluid chamber 25, and into the air-hoist pressure chamber 16, to facilitate the lifting of the load 20 with external force.

Thus, the load 20 in a balanced condition can be lifted or lowered with a minimum of external force.

When the lifting or lowering external force is removed, the pressurized fluid in the working fluid chamber 25 does not increase nor decrease, so that the fluid pressure in the working fluid and diaphragm chambers 25 and 26 is balanced. Therefore, the diaphragm 24 returns to the neutral position, the valve port 28 is closed by the valve 30, and the opening 31 of the valve rod 29 is closed by the cover 33 on the diaphragm 24. Consequently, the load 20 is kept in a balanced, suspended condition when the external force is removed.

Figure 7:
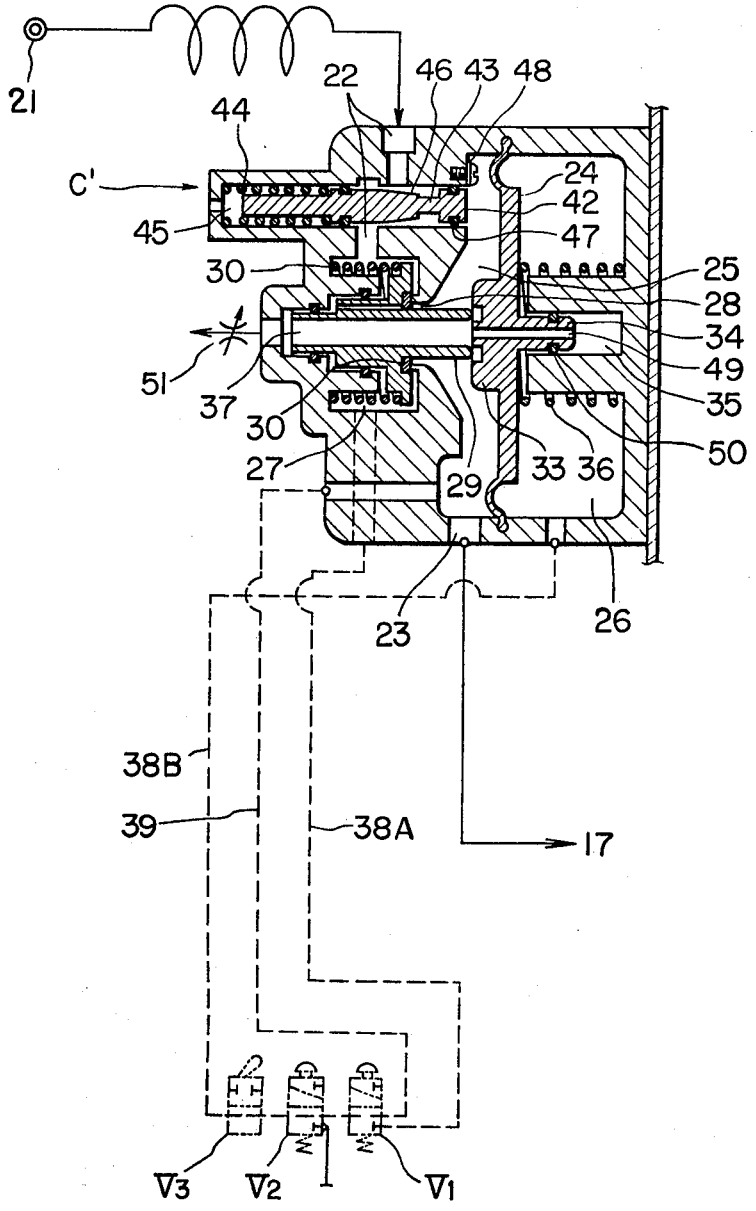
FIG. 7 is a cross-sectional view of a modified control device for regulating the lifting and lowering speed of the hoist.

FIG. 7 shows a control device C' that can adjust the lifting and lowering speed to the optimum level irrespective of the size of the load 20. On shifting the lifting change-over valve $V_1$ from the stop position in FIG. 7 to the position of FIG. 3, the load 20 is raised, as described before, by the rotational advance of the drum-cylinder 12. Associated with the passage 22 communicating with the pressurized fluid source 21, there is provided a throttle-type flow-rate control valve 43, with its pressure receiving surface 42 facing the working fluid chamber 25. This control valve 43, urged toward the working fluid chamber 25 by a spring 44, is slidably positioned in a valve opening 45 and is disposed so as to cross the passage 22. Th circumference of the control valve 43 is formed into a tapered surface 46. The valve opening 45 is sealedly cut off from the working fluid chamber 25 by an O-ring 47 fitted to the control valve 43, so the high-pressure fluid cannot leak into the working fluid chamber 25.

A stopper 48 is provided at the open end of the valve opening 45 so that the pressure receiving surface 42 of th control valve 43 will not be projected into the working fluid chamber 25 due to the urging of the spring 44.

When lifting the load 20, the pressure in the working fluid chamber 25 increases and the pressure receiving surface 42 of the control valve 43, which faces said chamber 25, moves to the left in FIG. 7. The resultant movement of the tapered surface 46 expands the throttle opening of the passage 22 as defined around the valve 43, whereby a constant rate of pressurized fluid is fed into the working fluid chamber 25 even if the pressure inside said chamber 25 increases. Therefore, even when the load 20 is heavy, its rising speed does not slow down. When the load 20 is light, the pressure working on the pressure receiving surface 42 is not great, so the control valve 43 does not move much to the left, and the expansion of the throttle opening of the passage 22 by the tapered surface 46 is limited. Therefore, even if the pressure inside the working fluid chamber 25 is low, pressurized air flows into the working fluid chamber 25, not exesssively but at a constant rate, so the lifting speed does not become unnecessarily high.

When the load 20 is heavy, the throttle opening (as defined around the valve 43) of the passage 22 is increased, thereby decreasing the fluid velocity and increasing the working fluid pressure. Meanwhile, when the load 20 is light, the throttle opening of the passage 22 is decreased, whereby the fluid velocity is increased and the working fluid pressure is decreased. By this means, the flow rate of high-pressure fluid is kept constant to always lift the load, whether heavy or light, at a constant, appropriate speed.

To lower the load 20, the lowering change-over valve $V_2$ is shifted to the position of FIG. 4, whereupon the wire rope 18 is paid off by the retreatal rotation of the drum-cylinder 12. Through a balance hole 49 formed through the cover 33 and guide rod 34, the working fluid chamber 25 communicates with the guide hole 35. One end of the guide hole 35 is closed. An O-ring 50 is fitted to the guide rod 34 sliding inside the guide hole 35, so that there should occur no leakage of high-pressure fluid between the diaphragm chamber 26 and the guide hole 35. Also a throttle valve 51 is provided in the passage connected to the opening 37 of the hollow valve rod 29, which throttle valve opens to the atmosphere. The opening of this throttle valve 51 is adjusted to control the discharge of high-pressure fluid so that the load 20 is lowered at a constant speed. Even if the fluid discharge through the controlled throttle valve 51 enters the working fluid chamber 25, the high-pressure fluid will be introduced through the balance hole 49 into the guide hole 35 where it works on the right-hand surface of the guide rod 34. When the hollow valve rod 29 detaches from the cover 33 on the diaphragm 24, the pressure receiving area of the diaphragm 24 increases by an amount that corresponds to the cross-sectional area of the hollow valve rod 29. However, this increase is offset by the increased pressure receiving area at the right end of the guide rod 34. Therefore, the throttle pressure does not cause the diaphragm 24 to move to the right to increase the capacity of the working fluid chamber 25. Thus, the pressure receiving area on both sides of the diaphragm 24 becomes equal. As a consequence, the diaphragm 24 remains uninfluenced by the variation in the pressure as controlled by the throttle valve 51. This means that the spring 36 need hot have great elasticity, whereby the diaphragm 24 is allowed to sensitively respond to the pressure fluctuations in the working fluid chamber 25 and the diaphragm chanmber 26. This permits lowering the load 20, whether heavy or light, at the desired constant speed conforming to the opening of the throttle valve 51.

Figure 8:
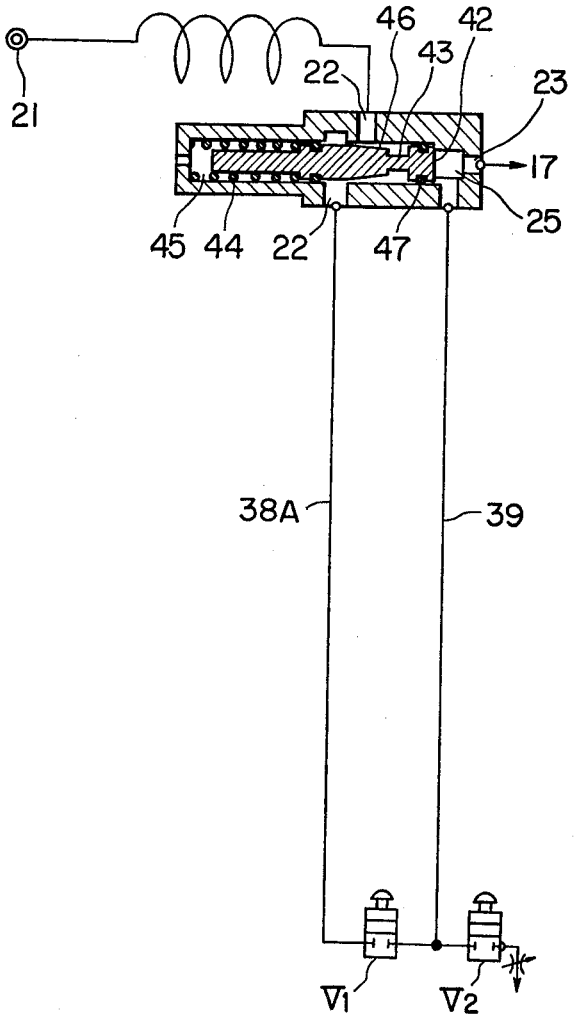
FIG. 8 is a cross-sectional view of a control device for regulating the lifting speed of the hoist.

When it is necessary to control only the load lifting speed, the passage 22 and the lifting change-over valve $V_1$ are connected by the conduit 38A and the working fluid chamber 25 is connected to the lifting and lowering change-over valves $V_1$ and $V_2$ by the manifold end of the conduit 39, as shown in FIG. 8. By actuating the lifting change-over valve $V_1$ to connect the conduits 38A and 39, high-pressure fluid is introduced into the working fluid chamber 25, whereby the flow-rate control valve 43 is moved to the extent that corresponds to the size of the load 20 and the throttle opening is adjusted accordingly. By this means, the load is lifted at the desired speed without being affected by the size of the load 20 (i.e., the weight of the object being hoisted).

As described above, the air-hoist according to this invention lifts and lowers the load by causing the drum-cylinder to rotatingly advance and retreat with respect to the fixed piston. Therefore, the drum-cylinder can be shortened. When not used, the piston is housed in the drum-cylinder, so that a space substantially equal to the drum-cylinder in length is enough. The seals for the rotational and reciprocative movements are provided between th piston and piston holder, and between the piston and cylinder, respectively. This permits the choice of the optimum seals for the two different movements, which leads to a smooth, trouble-free operation of the air hoist.

In the air-hoist control device of this invention, pressurized fluid in the working fluid chamber, which changes with the size of the load, is introduced into th diaphragm chamber to make equal the pressure receiving area on both sides of the diaphragm. Then the fluid whose pressure is balanced with the load is introduced into the diaphragm chamber as the control pressure. Therefore, it is unnecessary to adjust the control pressure each time the load to be lifted changes, which permits th aforesaid balanced lifting irrespective of the size of the load. This improves the air-hoist function by expanding its lifting capacity. Primarily comprising a hollow valve rod and a diaphragm, the control device is simply constructed and easy to operate. Also, the controlling change-over valves may be small since most of the working fluid introduced to the drum-cylinder does not flow through them. This reduces the size of the entire control device.

By providing in the passage leading to the pressurized fluid chamber a flow-rate control valve that automatically regulates the throttle opening of said passage according to the pressure variations in the working fluid chamber, the load can be lifted at the desired constant speed irrespective of its size.

Further, by making equal the pressure receiving areas on both sides of the diaphragm and connecting the guide hole, which extends on the diaphragm chamber side to receive the diaphragm guide rod, to the working fluid chamber through the balance hole, the desired lowering speed, unaffected by the size of the load, can be obtained through the adjustment of the throttle valve.

This invention is not limited to the above-described embodiments, but is considered applicable to the fluid control of cylinder-type and other fluid-operated hoists.

While not shown in the drawings, it will be appreciated that the control device of the present invention can be directly mounted onto the hoist, as by having the housing of the control device attached to the support member 3 of the hoist.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. An air hoist, comprising a nonrotatable support member having a ball-screw mechanism supported thereon, said ball-screw mechanism including a rotatable and axially movable screw coacting through balls with a nut fixed to the support member, a piston rotatably fitted on the support member and having a first fluid seal therebetween, means connecting the piston to the support member for preventing axial displacement of the piston, a drum-cylinder surrounding and axially slidably engaging the piston with a second fluid seal being disposed therebetween, the drum-cylinder being fixed to the screw and having an end wall which is axially spaced from the piston for forming a pressure chamber therebetween, the drum-cylinder being adapted to have a flexible cable-like element wrapped therearound, and passage means communicating with said pressure chamber and through which pressurized fluid is introduced and discharged from the pressure chamber, whereby the drum-cylinder rotatingly and axially advances by the action of the ball-screw mechanism to take up a flexible cable-like element when the pressurized fluid is introduced into the pressure chamber, and reversely rotatingly and axially retreats, under the influence of the self-weight of the load, to pay off the cable-like element when the pressurized fluid is discharged from the pressure chamber.

2. In combination with an air hoist, a working fluid control device for controlling the flow of pressurized air to and from the hoist, comprising:

means defining a pressurized fluid chamber to which pressurized fluid from a fluid source is introduced through a supply passage, a working fluid chamber communicating with the pressurized fluid chamber through a valve port, and a diaphragm chamber adjoining the working fluid chamber and separated therefrom by a movable diaphragm;

a movable hollow valve rod having a valve to open and close the valve port in response to the motion of the diaphragm, and a fluid discharge passage passing through the valve rod and valve and whose one end opens into the working fluid chamber and is opened and closed by the action of the diaphragm, and whose other end opens to the atomosphere;

a guide rod fixed to the diaphragm, the guide rod having the same cross-sectional area as the hollow valve rod and projecting toward the diaphragm chamber so that the diaphragm receives pressure on substantially the same areas on its working fluid chamber and diaphragm chamber sides when said one opening of the hollow valve rod is closed by the diaphragm;

conduit means connected between the pressurized fluid chamber, the working fluid chamber and the atmosphere;

shiftable valve means associated with said conduit means for selectively connecting and disconnecting the diaphragm chamber to or from the pressurized fluid chamber, the working fluid chamber and the atmosphere by operating said shiftable valve means;

said shiftable valve means including a lifting change-over valve for controlling the lifting of a load by the hoist, a lowering change-over valve for controlling the lowering of a load by the hoist, and a balancing change-over valve for maintaining the fluid pressure in the working fluid and diaphragm chambers balanced when a load is suspended from the hoist;

said conduit means including a first circuit providing fluid communication between the diaphragm chamber and said shiftable valve means, a second circuit providing fluid communication between the working chamber and said shiftable valve means, and a third circuit providing fluid communication between said pressurized fluid chamber and said shiftable valve means;

said lifting changeover valve when activated causing said first and third circuits to be in open communication with one another so that fluid is supplied from said pressurized fluid chamber through said first and third circuits into said diaphragm chamber to thereby displace same, which in turn axially displaces said hollow valve rod so that the valve associated therewith is moved into position so as to open said valve port, whereby the pressure fluid flows directly from said pressurized fluid chamber through said valve port into said working chamber and thence into the hoist;

said lowering change-over valve when activated causing said first circuit to be connected to a low-pressure reservoir or the atmosphere so that the pressure in the diaphragm chamber is reduced, whereby the diaphragm is moved away from the hollow valve rod so that the pressure fluid in the working chamber is vented to the atmosphere through the hollow valve rod, whereby the fluid in the air hoist likewise communicates with the atmosphere through the working chamber, thereby permitting lowering of a load; and said balancing change-over valve when activated causing said first and second circuits to be in fluid communication with one another so that pressure fluid is supplied from said diaphragm chamber through said first and second circuits to said working chamber, and vise versa, to maintain a pressure balance on opposite sides of the diaphragm.

3. A control device according to claim 2, including flow-rate control valve means for adjusting a throttle opening associated with said supply passage to permit lifting of a load at a substantially constant speed irrespective of the load size by actuating the control valve means according to the pressure variation in the working fluid chamber.

4. In a hoist actuated by a compressible pressurized fluid, comprising:

a support frame having a screw-threaded nut fixedly associated therewith, said nut defining a substantially horizontally extending rotational axis;

a screw-threaded shaft extending through and being in rotatable screw-threaded engagement with said nut, whereby rotation of said screw-threaded shaft in one direction causes one end thereof to axially move outwardly away from said nut, rotation of said shaft in the opposite direction causing said one end to axially move inwardly toward said nut;

a substantially cylindrical drum disposed concentric with and positioned in surrounding relationship to said screw-threaded shaft, said cylindrical drum being fixedly interconnected to said shaft so as to rotatably and axially move synchronously therewith;

piston means disposed within said cylindrical drum, said piston means having first seal means associated with the outer periphery thereof for creating a linearly slidable sealed engagement between said piston and said cylindrical drum;

means coacting between said piston means and said support frame for rotatably supporting said piston means on said support means while preventing said piston means from linearly or reciprocably moving relative to said frame in the axial direction of said drum;

second seal means coacting between said piston means and said support frame for creating a relatively rotatable fluid-type seal therebetween;

said cylindrical drum having a pressure wall which extends radially inwardly from the cylindrical peripheral wall of said drum and is axially spaced from said piston means for defining a pressure chamber therebetween; and passage means communicating with said pressure chamber for supplying a pressure fluid thereto so that said pressure fluid reacts with said piston means and said pressure wall for moving said pressure wall axially away from said piston means so that said drum, due to the rotative support by said shaft within said nut, is simultaneously rotated and axially displaced so that a selected point on the periphery of said drum moves along a helical path.

5. A hoist according to claim 4, wherein said pressure wall has the radially inner edge thereof fixedly connected to said shaft.

6. A hoist according to claim 5, wherein said support frame includes an elongated hollow cylindrical part which is closed at one end and which at its other end is in open communication with said pressure chamber, said shaft being disposed within said hollow part so that the end of said shaft which is disposed within said hollow part at a location remote from said pressure chamber is spaced from said hollow part so that the pressure fluid acts against the axial end face of said shaft.

7. A hoist according to claim 6, wherein said cylindrical drum is concentric with and surrounds said nut, and said piston means being disposed axially between said nut and said pressure wall.

8. A hoist according to claim 4, wherein said cylindrical drum is concentric with and surrounds said nut, and said piston means being disposed axially between said nut and said pressure wall.

9. A hoist according to claim 4, including an elongated flexible cable-like element wrapped around said cylindrical drum having one end hanging downwardly therefrom for attachment to a load, and control means associated with said passage means for controlling the flow of pressure fluid therethrough to thereby control the raising or lowering of said load, said control means including first means for permitting pressure fluid to be supplied through said passage means into said pressure chamber to thereby axially displace said drum in one direction to thereby cause rotation of said drum to wind said cable-like element onto said drum, said control means including second means for controlling the discharge of pressure fluid from said pressure chamber through said passage means so that the weight of the load causes the cable-like element to be unwrapped from the drum and causes rotation of the drum in the opposite direction which in turn causes axial displacement of the pressure wall in the opposite axial direction as permitted by the controlled discharge of pressure fluid from said pressure chamber.

10. In an air hoist according to claim 1, including a working-fluid control device for controlling the flow of pressurized air to or from the hoist, said control device including a working fluid chamber which communicates with the hoist, the pressure fluid being supplied from a pressurized fluid source through a passage to the working chamber, and shiftable flow-rate control valve means associated with said passage for controlling the flow therethrough so as to permit lifting of a load at a preselected desired speed irrespective of the load size, said flow rate control valve means being automatically shiftable in response to pressure variations in the working fluid chamber to thereby permit lifting of the load at the preselected desired speed.

* * * * *